US005340233A

United States Patent [19]

Motl

[11] Patent Number: 5,340,233

[45] Date of Patent: Aug. 23, 1994

[54] PNEUMATICALLY OPERATED RAMMER

[75] Inventor: Robert M. Motl, West Bend, Wis.

[73] Assignee: M-B-W Inc., Slinger, Wis.

[21] Appl. No.: 957,729

[22] Filed: Oct. 7, 1992

[51] Int. Cl.[5] ..... E01C 19/34

[52] U.S. Cl. ..... 404/133.05; 104/14; 404/133.1

[58] Field of Search ..... 404/133.05, 133.1, 133.2; 173/90, 117, 121, 122, 201, 205; 104/10, 14

[56] References Cited

U.S. PATENT DOCUMENTS

| | | | |
|---|---|---|---|
| 3,277,801 | 10/1966 | Horvath et al. | 404/133.1 |
| 3,552,410 | 1/1971 | Amtsberg | 137/56 |
| 3,630,127 | 12/1971 | Yamato | 404/133.1 |
| 3,964,182 | 6/1976 | Pomeret et al. | 37/1 |
| 4,156,576 | 5/1979 | Clavel et al. | 404/133 |
| 4,186,197 | 1/1980 | Tetsuo | 404/133.1 |
| 4,557,336 | 12/1985 | DeNise | 404/133.1 X |
| 4,850,437 | 7/1989 | Sudnishnikov et al. | 173/90 X |

OTHER PUBLICATIONS

"An Impact Compactor For Every Job", Racine Hydraulics: Machinery, Inc., Racine, Wis. (1963).

"Air Motor", Atlas Copco Tools Inc., Farmington Hills, Mich.

"Ground Pounder". M-B-W, Slinger, Wis.

*Primary Examiner*—Ramon S. Britts

*Assistant Examiner*—James A. Lisehora

*Attorney, Agent, or Firm*—Andrus, Sceales, Satrke & Sawall

[57] ABSTRACT

A pneumatically operated percussion apparatus for compacting soil, or other material. The apparatus includes a gear case that supports a percussion unit that is adapted to engage the soil to compact the same. A pneumatically operated motor is mounted on the gear case and air is supplied to the motor via a manually-operated "deadman" valve unit. A centrifugal clutch connects the output shaft of the motor to the percussion unit. The air flow to the motor is controlled by a governor to obtain a substantially uniform rotational speed for the motor output shaft.

12 Claims, 3 Drawing Sheets

PNEUMATICALLY OPERATED RAMMER

BACKGROUND OF THE INVENTION

Manually operated percussion units or rammers are frequently employed to compact soil or other material. A rammer is particularly adapted for use in narrow trenches which, in some instances, can be several feet deep.

A conventional rammer includes a gear case or frame having a handle to be grasped by the operator and a percussion unit is suspended from the gear case. The percussion unit is composed of a reciprocating ram which is held in a neutral position by two pair of opposed compression springs enclosed in a tube. The lower end of the tube carries a shoe which is adapted to engage the soil while the upper end of the ram is connected through a connecting rod and gear drive to the output shaft of a gasoline engine that is mounted on the gear case. With this construction, operation of the engine will reciprocate the ram and tube to compact the soil.

The conventional rammer, as used in the past, has been powered by a two-cycle gasoline engine and if the rammer is used in an enclosed environment, the atmosphere can be readily polluted by the exhaust gas from the engine. Similarly, if the rammer is used in a relatively deep trench, the exhaust fumes can pollute the trench causing a hazard to the operator.

As the rammer is normally operated in dusty conditions, it is necessary to frequently clean the air cleaner of the gasoline engine and due to the dusty conditions of operation, the conventional rammer is subject to high maintenance and repair cost.

SUMMARY OF THE INVENTION

The invention is directed to a pneumatically operated percussion apparatus or rammer, which is employed to compact soil or other materials.

The rammer of the invention includes a gear case having a handle to be grasped by the operator and a percussion unit is supported from the gear case.

The percussion unit is driven by a pneumatic motor which is mounted on the gear case, and air is supplied to the motor through a manually operated valve unit. The air flow to the motor is controlled by a governor which serves to provide a substantially uniform output speed for the output shaft of the motor regardless of variations in air pressure or in the load encountered by the rammer.

In addition, a centrifugal clutch is inter-connected between the output shaft of the motor and the percussion unit and the clutch acts to delay operation of the percussion unit until the motor is operating at a given speed so that there is no load on the motor as it is initially started.

The use of the pneumatic motor eliminates pollution at the working site. Thus, the rammer can be used in enclosed environments or in deep trenches without the buildup of toxic exhaust fumes.

The pneumatically operated rammer is less hazardous to the operator in that there are no sparks generated through operation of the motor which could provide a potential hazard in the event the rammer is operating in a trench where a gas line may have been ruptured. Further, the pneumatically operated rammer does not have a hot muffler, as does a gasoline engine, so that any potential danger of contact with a hot muffler is also eliminated.

The pneumatic rammer of the invention provides a consistent and uniform output regardless of any fluctuations in air pressure or load.

As a further advantage, the pneumatically operated rammer is lighter in weight than a gasoline powered rammer, thereby making it more maneuverable and less fatiguing for the operator.

Other objects and advantages will appear during the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
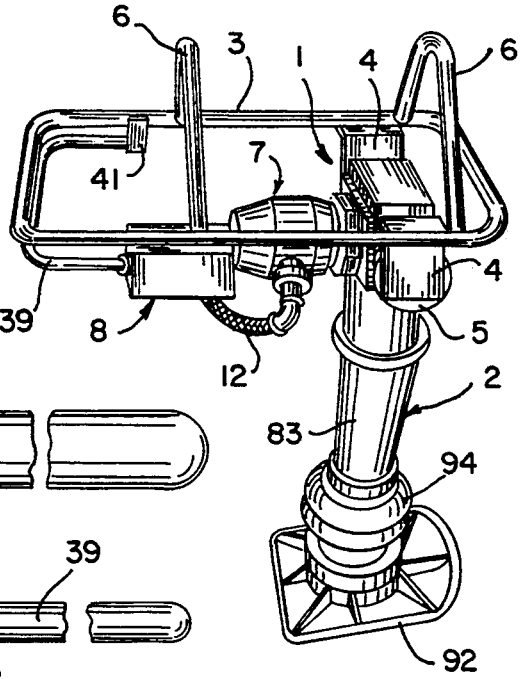
FIG. 1 is perspective view of the pneumatically operated rammer of the invention.

The percussion apparatus or rammer of the invention includes a gear case or frame 1 which supports a lower percussion unit 2. The gear case is provided with a generally rectangular handle 3 and a pair of plates 4 extend downwardly from opposite sides of handle 3 and are connected through resilient isolation mounts 5 to the sides of the gear case 1. The isolation mounts 5 minimize the transmission of vibrations from the percussion unit 2 to the handle 3.

A pair of inverted, generally U-shaped guards 6 extend upwardly from the handle 3, as illustrated in FIG. 1.

Percussion unit 2 is driven by a pneumatic motor 7 which is mounted on gear case 1 and air under pressure is supplied to motor 7 through a manually operated valve assembly 8 which is mounted on handle 3.

Figure 4:
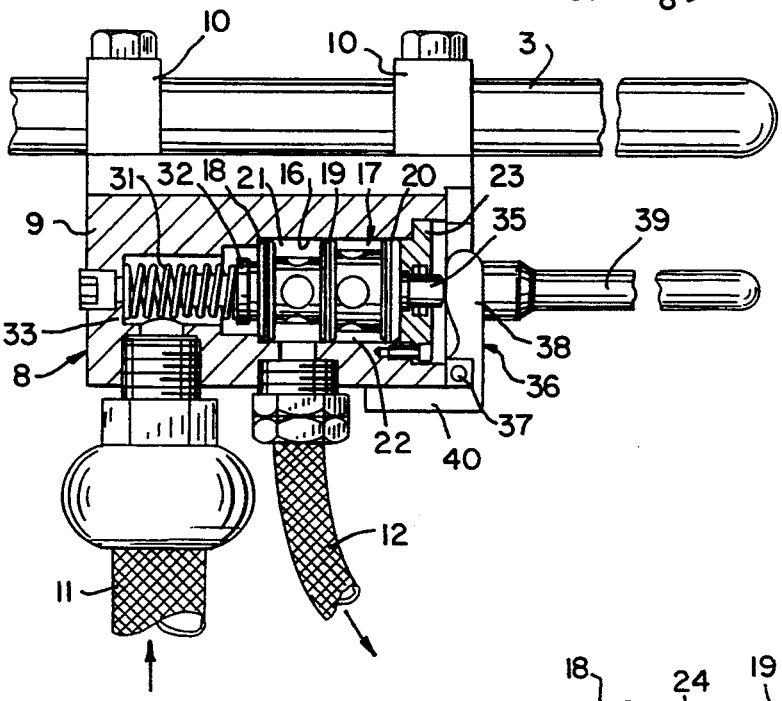
FIG. 4 is a view with parts broken away in section showing the air supply valve.

As illustrated in FIG. 4, valve assembly 8 includes a valve block 9 which is connected to handle 3 through a pair of connecting bars 10 which are attached to the block 9 through suitable screws or other fasteners. Air is supplied to the valve body 9 through a conduit 11 which is connected to a suitable source of air pressure, such as an air compressor which is located at a remote location. An outlet port of valve assembly 8 is connected via a conduit 12 to the motor 7.

Figure 5:
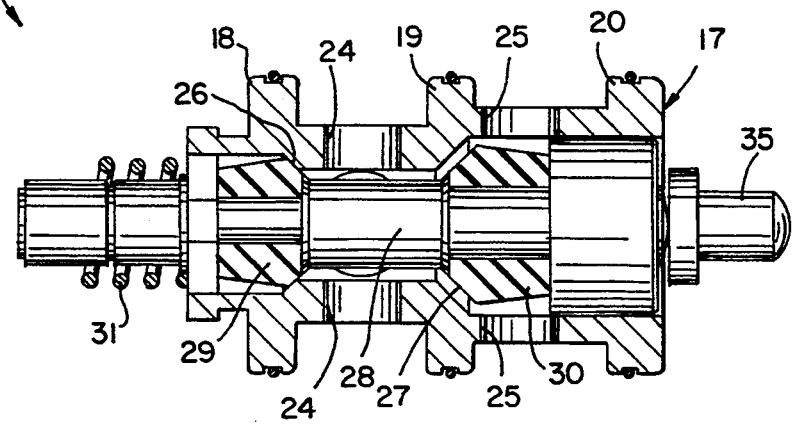
FIG. 5 is a longitudinal section of the air supply valve.

As best shown in FIGS. 4 and 5, valve body 9 is formed with an internal cavity 16 which receives a spool valve 17 having a series of spaced annular flanges 18, 19, and 20. Each of the flanges 18,19,20 can be provided with a peripheral groove which receives an O-ring seal to seal the flange against the internal wall of cavity 16.

The space between flanges 18 and 19 defines an annular chamber 21 while the space between the flanges 19 and 20 defines a second annular chamber 22.

To retain spool 17 within cavity 16, a cap 23 is threaded within an end of the cavity and bears against the flange 20 of the spool.

A plurality of ports 24 are formed in the spool between flanges 18 and 19 and communicate with chamber 21, and similarly a second group of ports 25 are formed between the flanges 19 and 20 and establish communication with chamber 22.

Located on the inner surface of spool 8 are valve seats 26 and 27. Valve seat 26 is located upstream of the ports 24 while valve seat 27 is located between ports 24 and 25.

Mounted for sliding movement within spool 17 is a plunger 28. The plunger is provided with a pair of annular valves 29 and 30. Valve 29 is adapted to engage valve seat 26 while valve 30 is positioned to engage the valve seat 27. As shown in FIG. 5, when valve 29 is closed, valve 30 will be open and conversely when valve 30 is closed, valve 29 will be open.

Valve 29 is biased to a closed position by a coil spring 31 which is positioned around the stem of the plunger 28. One end of spring 31 bears against a collar 32 formed on plunger 28, while the opposite end of the spring engages an internal ledge 33 in the cavity 16. The force of spring 31 will urge valve 29 to the closed position and similarly will urge valve 30 to the open position.

To move plunger 28 relative to spool 17, a pin 35 projects through the outer end of spool 17 and engages the end of plunger 28. The opposite end of pin 35 is engaged with an L-shaped trigger 36 which is pivoted to valve body 9 at pivot 37. One leg 38 of trigger 36 is secured to one end V-shaped actuator bar 39, while the other leg 40 of the trigger is adapted to engage the outer surface of valve body 9 and provides a stop to limit pivotal movement of the trigger in a clockwise direction as viewed in FIG. 4. The other end of actuator bar 39 is pivoted to a bracket 41 that extends downwardly from handle 3. With this construction, actuator bar 39, which serves as a "deadman" handle, is biased downwardly away from handle 3 by gravity and by the force of spring 31 of valve assembly 8.

The operator grasping handle 3 and actuator bar 39 will pivot the bar upwardly toward the handle, thus pivoting the leg 38 of trigger 36 inwardly to move plunger 28 inwardly to open valve 29 and correspondingly close valve 30. Opening valve 29 will permit air from the supply conduit 11 to pass through the ports 24 into chamber 21 and then through the conduit 12 to the motor 7. Release of the actuator bar 39 by the operator will cause the actuator bar to be pivoted downwardly under the influence of gravity and spring 31, thus cutting off the flow of air to the motor 7.

Figure 2:
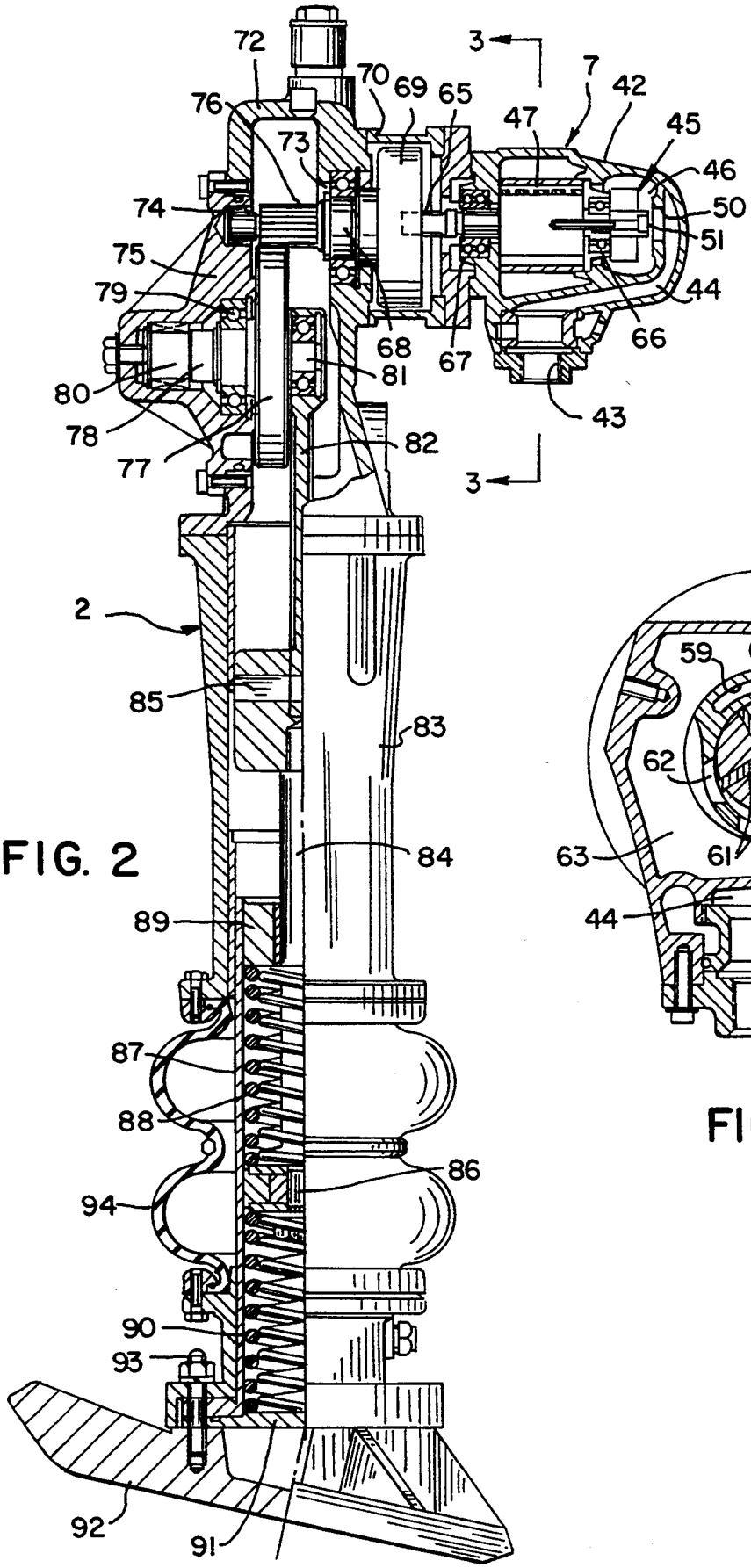
FIG. 2 is vertical section of the rammer.
Figure 3:
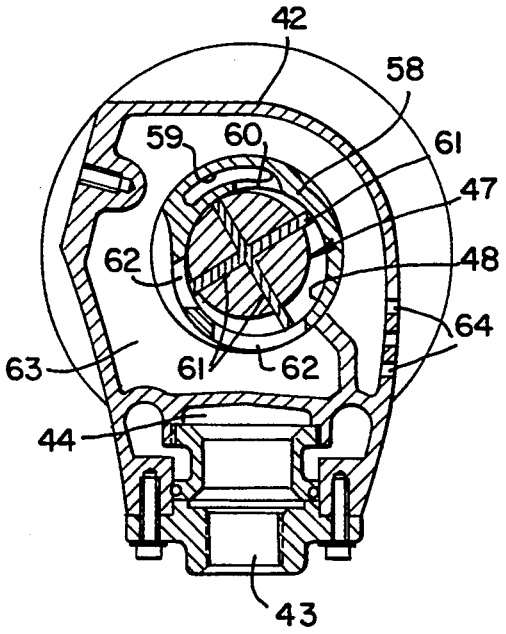
FIG. 3 is a transverse section taken along line 3—3 of FIG. 2.

The air motor 7 is illustrated in FIGS. 2 and 3. The air motor can be a conventional type such as that sold by Atlas Copco Tools Inc. of Farmington Hills, Mich.

The air motor 7 includes an outer generally bell-shaped housing 42 having an inlet 43 to which the air line 12 is connected. Inlet 43 communicates with a passage 44, and a governor 45 mounted in chamber 46 controls the flow of air from the passage 44 to a rotor 47 which is mounted for rotation within a rotor chamber 48.

Figure 6:
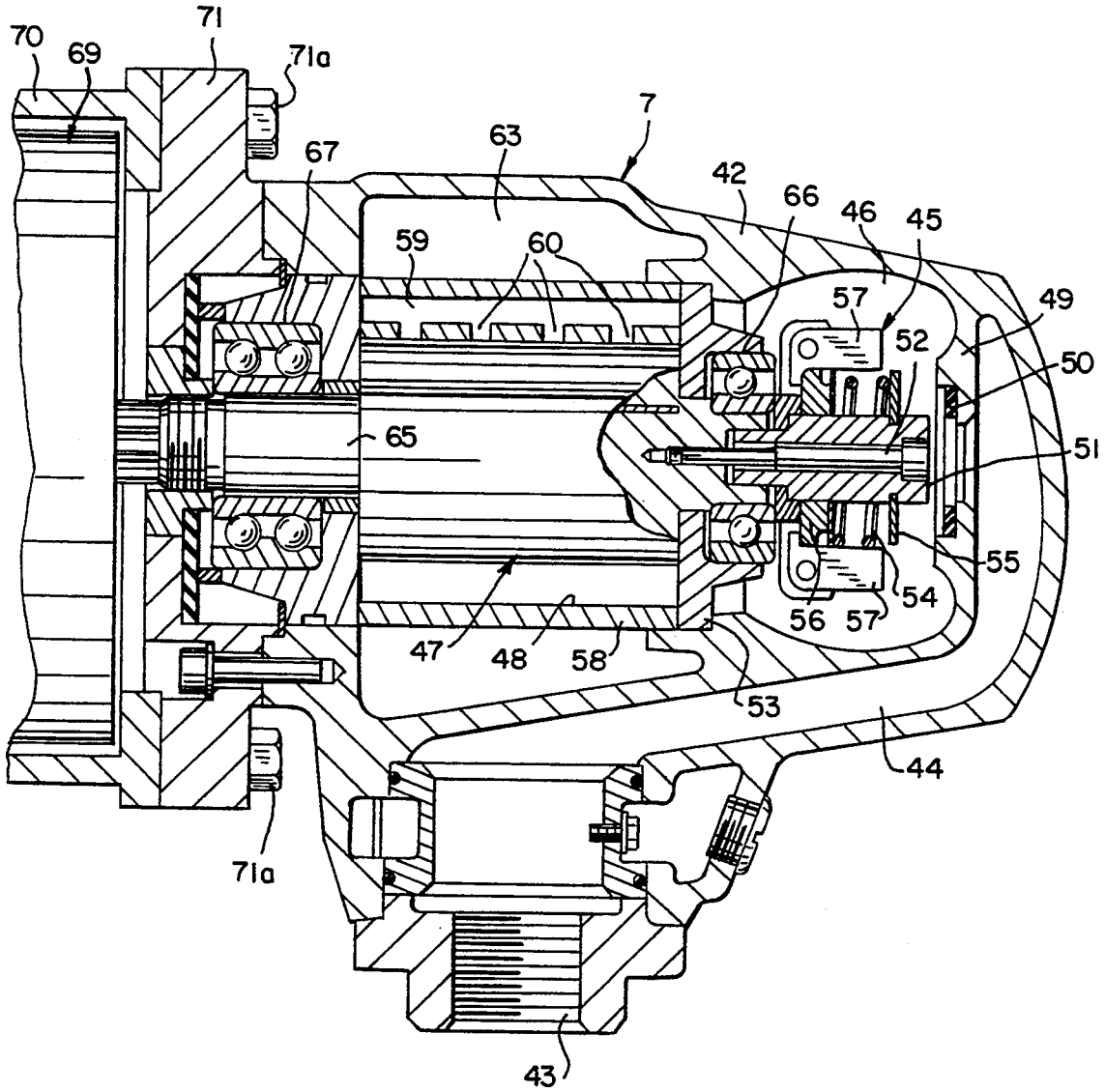
FIG. 6 is an enlarged longitudinal section of the pneumatic motor.

As shown in FIG. 6, the internal wall 49 of housing 42 defines a valve seat 50 which connects the passage 44 and the governor chamber 46 and flow of air through the seat is controlled by a valve 51. Valve 51 is mounted on a spindle 52 and the spindle, in turn, is splined or otherwise connected to rotor 47 in a manner such that spindle and valve 51 will rotate with the rotor but can move axially of the rotor. The valve 51 is urged to an open position by a spring 54 which is interposed between a retainer 55 on the valve 51 and base 56.

Governor 45 includes a plurality of flyweights 57 which are pivoted to base 56 and on rotation of the rotor 47, the flyweights will swing outwardly under centrifugal force causing valve 51 to move axially toward a closed position.

If an increased load is encountered, or if the pressure of the air being supplied to the motor is reduced, the rotor speed will decrease causing the fly weights to pivot inwardly and move the valve 51 toward the full open position to increase the air flow to the motor, thus maintaining a substantially uniform output speed for the rotor 47.

Rotor 47 is mounted for rotation in an outer cage 58 and the air admitted to governor chamber 46 flows into a passage 59 in cage 58 and then passes through a series of openings 60 to the rotor chamber 48. Rotor 47 includes a series of radially movable vanes 61 and the incoming air will engage the vanes to rotate the rotor with the air being exhausted through outlets 62 to chamber 63. The air in chamber 63 is then exhausted to the atmosphere through outlet ports 64.

Governor 45 which is associated with the air motor 7 provides a substantially uniform output speed for the rotor shaft 65 regardless of fluctuations in air pressure or load on the percussion unit.

End plate 53 of rotor 47 is journaled for rotation within housing 42 by a bearing assembly 66 and the output shaft 65 of the rotor is journaled within a bearing assembly 67.

As illustrated in FIG. 2, the rotor shaft 65 is connected to an axially aligned shaft 68 of percussion unit 2 through a centrifugal clutch unit 69 which is mounted within clutch housing 70. As shown in FIG. 6, clutch housing 70 is mounted to the end plate 71 of the pneumatic motor housing 42 through a series of bolts 71*a*.

Centrifugal clutch unit 69 is a conventional type and the rotor shaft 65 is operable connected to one clutch member while the shaft 68 is connected to a second clutch member. The clutch members are normally biased out of engagement and as the rotor 47 rotates and reaches a predetermined speed, the clutch members will engage to thereby transmit rotation from rotor shaft 65 to shaft 68. The use of the centrifugal clutch insures that the motor will start without load.

Shaft 68 extends through an opening in casing 72 of percussion unit 3 and is journaled within a roller bearing assembly 73 and a needle bearing assembly 74 which is mounted in a recess in cover 75 that encloses an aperture in casing 72.

The central portion of shaft 68 carries a pinion 76 which is engaged with a gear 77 located within casing 72 and gear 77 is carried by a horizontal shaft 78 that is mounted for rotation in a radial bearing assembly 79 and a needle bearing assembly 80.

Pivoted to gear 77 at a location offset from the axis of the gear by pin 81 is a connecting rod 82 and the rod extends downwardly through casing 72 and into lower casing 83 that houses a ram head 84. The upper end of ram head 84 is connected to the lower end of connecting rod 82 by pin 85, while the lower end of ram head 84 carries a piston 86 which is mounted for sliding movement within a spring box or tube 87. As shown in FIG. 2, an upper spring 88 is interposed between the upper surface of piston 86 and a block 89, while a lower spring 90 extends between the lower surface of piston 86 and a cap 91 which is secured to the lower end of the spring box 87. Shoe 92, which is adapted to engage the soil or other material to be compacted, is connected to the lower end of spring box 87 through screws 93. A bellows 94 is connected between spaced flanges on the lower casing 83 and spring box 87 and serves to enclose the spring box 87.

With this construction, the piston 86 and ram head 84 are maintained in a neutral position by the two opposed springs 88 and 90. As the gear 77 is rotated, connecting rod 82 and ram head 84 will move in a reciprocating path thereby alternately compressing the springs 88 and 90 and providing a vibratory motion for the shoe 92.

The use of the air motor 7 as the power source provides a consistent output for the rammer regardless of fluctuations in air pressure or load on the shoe 92.

The rammer of the invention eliminates pollution at the working site, making the rammer particularly adaptable for use in enclosed environments or in deep trenches where exhaust fumes could accumulate if the rammer is driven by a gasoline engine.

The use of the air motor eliminates the clogging of air cleaners and other maintenance problems which are associated with the use of a gasoline engine under the dusty conditions in which the rammer will normally operate.

Various modes of carrying out the invention are contemplated as being within the scope of the following claims particularly pointing out and distinctly claiming the subject matter which is regarded as the invention.

I claim:

1. A pneumatically operated percussion apparatus for compacting soil and other materials, comprising a supporting structure, a percussion unit mounted on the supporting structure and including a percussion member disposed to engage the soil, a pneumatic motor mounted on the supporting structure and having an output shaft, air supply conduit means for supplying air under pressure to said motor, manually operated valve means mounted on the supporting structure and disposed to open and close said air supply conduit means, centrifugal clutch means interconnecting said output shaft and said percussion unit, and speed governing means interconnecting said valve means and said motor for controlling the supply of air to said motor to obtain a substantially constant speed of rotation for said output shaft.

2. The apparatus of claim 1, wherein said supporting structure comprises a handle and said valve means is mounted on the handle.

3. The apparatus of claim 1 and including manually operable deadman actuator means mounted for movement on the handle between a lower inoperative position and an upper operative position, said actuator means being operably connected to said valve means.

4. The apparatus of claim 3, and including biasing means for biasing said valve means to a closed position, said actuator means disposed to move said valve means from the closed position to the open position as said actuator means is moved from the inoperative position to the operative position.

5. The apparatus of claim 4, wherein said actuator comprises a bar disposed parallel to said handle, and mounted for pivotal movement relative to said handle between said inoperative and operative positions.

6. The apparatus of claim 5, wherein said handle is generally rectangular in shape and said actuator bar extends along one side of said handle.

7. The apparatus of claim 3, and including biasing means for urging said valve means to a closed position, said biasing means also disposed to bias said actuator means to the inoperative position.

8. The apparatus of claim 5, wherein said actuator means also includes a lever pivoted relative to said frame and interconnecting said actuator bar and said valve means.

9. The apparatus of claim 1, wherein said pneumatic motor comprises a casing having a first chamber and a second chamber and having a passage providing communication between said chambers, a rotor disposed in said second chamber and connected to said output shaft, said speed governing means disposed in said first chamber and having means responsive to the speed of the engine for controlling entry of air to said first chamber.

10. The apparatus of claim 9, wherein said casing includes inlet means communicating with said first chamber for permitting entry of air to said first chamber, said speed governing means including a valve member disposed to open and close said inlet means and mounted for axial movement in a direction toward and away from said inlet means, said speed governing means also including flyweight means constructed and arranged such that an increase in speed of the rotor will cause said flyweight means to pivot outwardly under centrifugal force to move said valve member axially toward said inlet means.

11. A pneumatically operated percussion apparatus for compacting soil and other material, comprising a gear case, a percussion unit mounted on the gear case and including reciprocating ram means to engage the soil, a pneumatic motor mounted on the gear case and including a rotor having an output shaft, an air supply conduit connecting a source of air under pressure with said motor, manually operated valve means mounted on the gear case and operably connected in said air supply conduit and disposed to open and close said air supply conduit, air control means disposed in said air supply conduit between said valve means and said motor for controlling the flow of air through said air supply conduit to the rotor and providing a substantially uniform rotational speed for said output shaft, and connecting means connecting said output shaft with said ram means and converting rotation of said output shaft to reciprocating motion of said ram means, said connecting means including a centrifugal clutch.

12. The apparatus of claim 11, wherein said air control means comprises inlet means in said motor and disposed in communication with said rotor, a valve member disposed to open and close said inlet means, and means responsive to a decrease in speed of said rotor due to an increased load on said ram means for moving said valve member toward an open position to increase the flow of air through said inlet means to said rotor.

* * * * *